US010947726B2

(12) United States Patent
Muster et al.

(10) Patent No.: US 10,947,726 B2
(45) Date of Patent: Mar. 16, 2021

(54) SELF-CAMBERING OF TIMBER ELEMENTS

(71) Applicant: Timber Structures 3.0 AG, Thun (CH)

(72) Inventors: Marcel Muster, Zurich (CH); Stefan Zöllig, Thun (CH); Erich Sidler, Ottenbach (CH)

(73) Assignee: Timber Structures 3.0 AG, Thun (CH)

( * ) Notice: Subject to any disclaimer, the term of this patent is extended or adjusted under 35 U.S.C. 154(b) by 0 days.

(21) Appl. No.: 16/331,436

(22) PCT Filed: Aug. 30, 2017

(86) PCT No.: PCT/IB2017/055214
§ 371 (c)(1),
(2) Date: Mar. 7, 2019

(87) PCT Pub. No.: WO2018/047041
PCT Pub. Date: Mar. 15, 2018

(65) Prior Publication Data

US 2019/0194941 A1 Jun. 27, 2019

(30) Foreign Application Priority Data

Sep. 7, 2016 (CH) ..... 01155/16

(51) Int. Cl.
*E04C 2/32* (2006.01)
*E04B 5/23* (2006.01)
(Continued)

(52) U.S. Cl.
CPC ..... *E04C 2/328* (2013.01); *E04B 5/23* (2013.01); *E04C 2/12* (2013.01); *E04C 2/26* (2013.01);
(Continued)

(58) Field of Classification Search
CPC . E04C 2/12; E04C 2/328; E04C 2/326; E04C 3/12; E04C 3/14; E04B 2005/232;
(Continued)

(56) References Cited

U.S. PATENT DOCUMENTS 513,470 A * 1/1894 Kukkuck ..... B27H 1/00 144/270
4,745,718 A * 5/1988 O'Sullivan ..... E04C 3/14 52/223.12
(Continued)

FOREIGN PATENT DOCUMENTS

CH 678440 A5 9/1991
DE 2510262 A1 * 9/1976 ..... E04G 23/0233
(Continued)

OTHER PUBLICATIONS

Espacenet Machine_Translation_DE9408382. Accessed Jun. 20, 2020. (Year: 2020).*
(Continued)

*Primary Examiner* — Christine T Cajilig
(74) *Attorney, Agent, or Firm* — Blank Rome LLP

(57) ABSTRACT

The invention relates to a method for the cambering of a wooden element, comprising the steps of: cutting to form at least one incision in a surface of the wooden element; inserting an expansive material into the at least one incision of the wooden element; letting the expansive material expand in the at least one incision so that a cambering of the wooden element is achieved.

24 Claims, 7 Drawing Sheets

(51) Int. Cl.

| | |
|---|---|
| ***E04C 2/12*** | (2006.01) |
| ***E04C 2/26*** | (2006.01) |
| ***E04C 3/12*** | (2006.01) |
| ***E04G 23/02*** | (2006.01) |

(52) U.S. Cl.
CPC ..... *E04C 3/12* (2013.01); *E04B 2005/232* (2013.01); *E04G 2023/0248* (2013.01)

(58) Field of Classification Search
CPC .... E04G 2023/0248; B27H 1/00; B27M 1/00; B27M 1/003; B27M 1/006
See application file for complete search history.

(56) References Cited

U.S. PATENT DOCUMENTS

| | | | | | |
|---|---|---|---|---|---|
| 4,965,973 | A * | 10/1990 | Engebretsen | E04C 3/18 | 52/223.8 |
| 5,244,746 | A * | 9/1993 | Matsui | B32B 3/30 | 191/22 DM |
| 9,090,515 | B2 * | 7/2015 | Taverne | C04B 41/53 | |
| 2004/0128948 | A1 * | 7/2004 | Killen | B32B 27/302 | 52/782.1 |
| 2005/0086904 | A1 * | 4/2005 | Foley | E04C 2/288 | 52/782.1 |
| 2007/0000198 | A1 * | 1/2007 | Payne, Jr. | E04B 5/10 | 52/414 |
| 2013/0330508 | A1 * | 12/2013 | Sato | B32B 3/30 | 428/136 |
| 2016/0121515 | A1 | 5/2016 | Zollig | | |

FOREIGN PATENT DOCUMENTS

| | | | | | |
|---|---|---|---|---|---|
| DE | 8325456-1 | | | 12/1983 | |
| DE | 9408382 | U1 | | 8/1994 | |
| DE | 202013001849 | U1 | | 5/2013 | |
| EP | 0553420 | A1 | * | 8/1993 | B27H 1/00 |
| FR | 40032 | E | * | 3/1932 | E04C 2/12 |
| GB | 1096982 | A | * | 12/1967 | E04C 2/296 |
| WO | WO-2014/173633 | A1 | | 10/2014 | |

OTHER PUBLICATIONS

International Search Report and Written Opinion for PCT/IB2017/055214, dated Nov. 30, 2017, 7 pages.

* cited by examiner

SELF-CAMBERING OF TIMBER ELEMENTS

RELATED APPLICATIONS

This application is a national phase of PCT/IB2017/055214, filed on Aug. 30, 2017, which claims the benefit of Swiss Patent Application No. 01155/16, filed on Sep. 7, 2016. The entire contents of these applications are hereby incorporated by reference.

TECHNICAL FIELD

The invention relates to a self-cambering of timber elements, in particular for ceilings and roofs.

PRIOR ART

The timber-concrete composite (TCC) mode of construction with Dowel laminated timber (DLT) elements is favored in the construction of single-family and multiple-family dwellings. The simple system combines the good properties of timber and concrete.

In such ceilings, the timber element situated at the bottom is primarily loaded in tension and the concrete situated thereon is mainly loaded in compression. The shear-resistant connection between DLT elements and the concrete is achieved, inter alia, with milled-in notches, together with screws fitted on the construction site. At the current time, few, yet large, notches are arranged. The notches and screws make the production of a TCC ceiling with DLT more expensive since, on the one hand, a lot of material has to be milled out and additional work steps on the construction site are necessary. DE202013001849U1 proposes sawtooth-like notches having an undercut extending at a right angle to the notches in order to achieve a shear-resistant connection between the timber element and the concrete without screws. However, the production of such notches and undercuts is complicated and the notches still require a high degree of material wear.

Nowadays, the DLT elements are understayed (supported) on the construction site before the concrete is poured thereon. This is necessary since the elements under the load of the fresh concrete would otherwise excessively bend. The understaying and the long deshuttering times lead to a relatively slow construction sequence and to relatively high costs. The high degrees of bending are also a problem in other components made of timber. Glued-laminated timber supports are therefore produced in partially curved form or subsequently planed such that a curvature results, in order to avoid the understaying. However, the complexity in producing curved timber elements is substantial and, in the case of the subsequent routing of the cambering, the material consumption is high. CH678440 discloses that the cambering can be achieved by means of struck-in wedges. However, this is also time-consuming and requires the precise cutting-in of gaps tailored to the wedges. Similar problems also occur in DLT timber ceilings or solid timber ceilings and other load-bearing timber parts.

The use of cross-laminated timber for creating load-bearing ceilings and in particular timber-concrete composite ceilings is known. Mechanical connecting means, such as screws or flat steels, are usually used as connection between timber and concrete. In the construction sequence, the same problem as in DLT elements arises. In order to prevent bending, the cross-laminated timber panels have to be understayed, which slows down the production process and requires extra work effort.

SUMMARY OF THE INVENTION

It is an aim of the invention to solve the described problems of the prior art.

According to the invention, this aim is achieved by a cambered timber element and a method for producing such an element. The invention is characterized in that a cambering of the timber element is achieved by inserting an expansive material into incisions in the surface of the timber element. This has the advantage that the cambering can also be quickly realized on the construction site, and an understaying of the timber element can be avoided by means of the camber, which counteracts the weight of the timber, the weight of the concrete situated thereon or of another carrying weight.

Further advantageous embodiments are specified in the dependent claims.

The micro-notches, in particular their shape and/or dimensioning, afford a particularly good hold between the timber element and the composite material of a timber composite ceiling without diminishing the carrying force of the timber element.

BRIEF DESCRIPTION OF THE FIGURES

The invention will be explained in more detail with reference to the appended figures, in which.

WAYS OF IMPLEMENTING THE INVENTION

The invention is described below in conjunction with a TCC ceiling, but is not limited to such a TCC ceiling.

Figure 1:
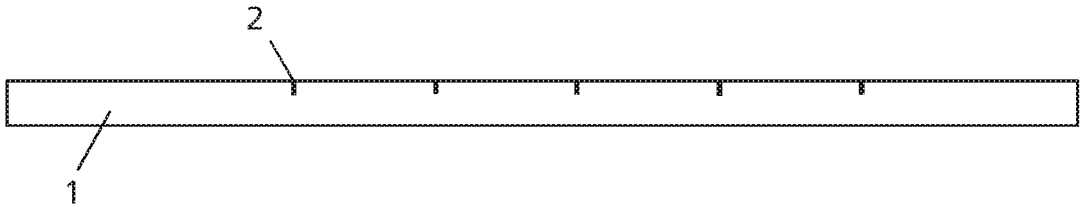
FIG. 1 shows a section through an exemplary embodiment of a timber element having incisions.

FIG. 1 shows an exemplary embodiment of a, preferably uniaxially load-bearing, timber element 1 for a TCC ceiling. The timber element 1 has incisions 2 on a surface which are designed to be filled with an expansive material. The surface is preferably the surface which will be later in contact with a concrete layer of the TCC ceiling. These incisions 2 are preferably cut in during the production of the timber element 1, for example at the factory. However, the incisions 2 could also be directly cut in at the construction site. The incisions 2 can be obtained, for example, by a milling cutter or a saw or other machining tools. The incisions are preferably 1 mm to 100 mm, preferably 2 mm to 50 mm, wide and 5 mm to 150 mm, preferably 10 mm to 80 mm, deep. However, the incisions 2 can also have different dimensions.

Figure 2:
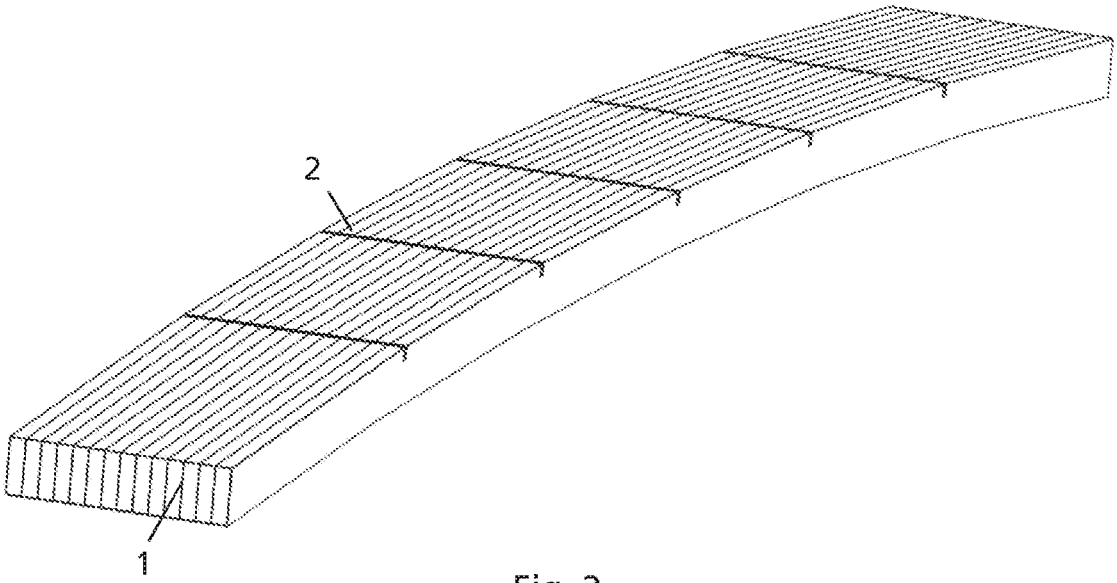
FIG. 2 shows a three-dimensional illustration of the timber element from FIG. 1 which is cambered by means of an expansive material in the incisions.

The incisions 2 are filled with an expansive material in order to camber the timber element 1. The expansive material is designed to expand after being introduced such that the expansive material presses onto the lateral walls of the incisions 2 and leads to a curvature of the timber element 1, as is shown in FIG. 2. The manner of the cambering can be controlled by the arrangement of the incisions 2 on the surface of the timber element 1 and/or the coefficient of expansion of the expansive material. The expansive material can be produced, for example, from two materials which, after being mixed, carry out a chemical reaction which leads to an expansion of the mixture. An example of an elastic material is expanding mortar (also referred to as swelling mortar) which is produced by mixing with water and swells up after mixing. The expansive material is preferably liquid or pasty, with the result that it can be inserted (poured or spread) into the incisions 2 in a simple and rapid manner. The expansive material is preferably introduced into the incisions 2 on the construction site, with the result that the curvature is produced first in situ. This has the advantage that, for transportation, the timber elements 1 are furthermore parallelepipedal and easier to stack. However, the curvature with the expansive material could also be produced already at the factory.

Figure 3:
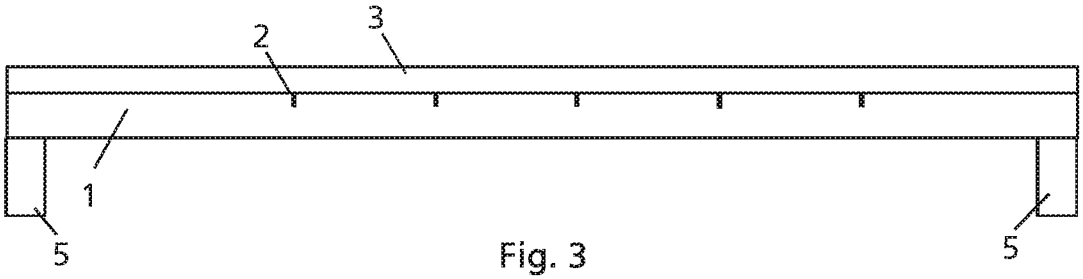
FIG. 3 shows a section through a TCC ceiling having the timber element from FIG. 2.

FIG. 3 now shows the TCC ceiling with the timber element 1. The cambered timber element 1 is held by (in this case two) holders 5. Not only bearing holders, such as supports, walls, wall elements, metal elements, etc., but also suspension holders, such as, for example, ropes, cables, etc., can function as holders 5. The timber element 1 can possibly be connected, for example screwed, to the holders 5. The curvature of the timber element 1 is preferably designed in such a way that the timber element 1 is lowest at the points at which the timber element 1 is held by the holders 5 and rises between these points to a highest point and then slopes away again. The timber element 1 thus forms a type of arch. The apex is preferably arranged centrally between the two holder points. However, for certain applications with asymmetrical load distributions, use can also be made of asymmetrical arches. The liquid concrete 3 is now applied to the cambered timber element 1. The weight of the concrete 3 presses the cambered timber element 1 into a less curved position again. The less curved position can be an arch with a lower apex/maximum point, in the ideal case a straight line or else, in a more unfavorable case, a negative arch whose apex is situated below the carrying points. After curing the concrete 3, the TCC ceiling is complete. A water-impermeable layer, for example a plastic sheet, is preferably arranged between the surface of the timber element 1 and the concrete layer 3. In order to achieve a shear-resistant connection between the timber element 1 and the concrete layer, use is preferably made of connecting means, such as, for example, screws, notches, etc.

The timber element 1 can be a solid timber element. In this case, the fiber direction is advantageously oriented in the support direction and/or oriented at a right angle to the incisions 2. However, the timber element 1 can also be an element made up of a plurality of adhesively bonded timber elements.

Thus, in FIGS. 1, 2 and 3, the timber element 1 is a DLT element having a plurality of parallel adhesively bonded or doweled boards whose main fiber directions are all oriented in parallel. The adhesive surface or contact surface between the boards of the DLT element is preferably in each case at a right angle to the surface of the timber element 1. Such DLT elements or solid timber elements are suitable above all for application areas in which the timber element 1 or the TCC ceiling requires only one carrying direction. This is the case, for example, in bridges or in ceilings whose carrying behavior is oriented only in one direction.

Alternatively, it is also possible that the timber element 1 is a cross-laminated timber element, i.e. consists of a plurality of parallel timber layers whose main fiber direction in adjacent layers is rotated by a certain angle, preferably 90°, and is adhesively bonded (preferably glued). Cross-laminated timber elements are suitable particularly for applications in which the timber element 1 or the TCC ceiling has a plurality of carrying directions. Such an application case is, for example, a TCC ceiling which transmits the carrying loads to holders 5, such as, for example, supports, on all four sides or corners.

Figure 5:
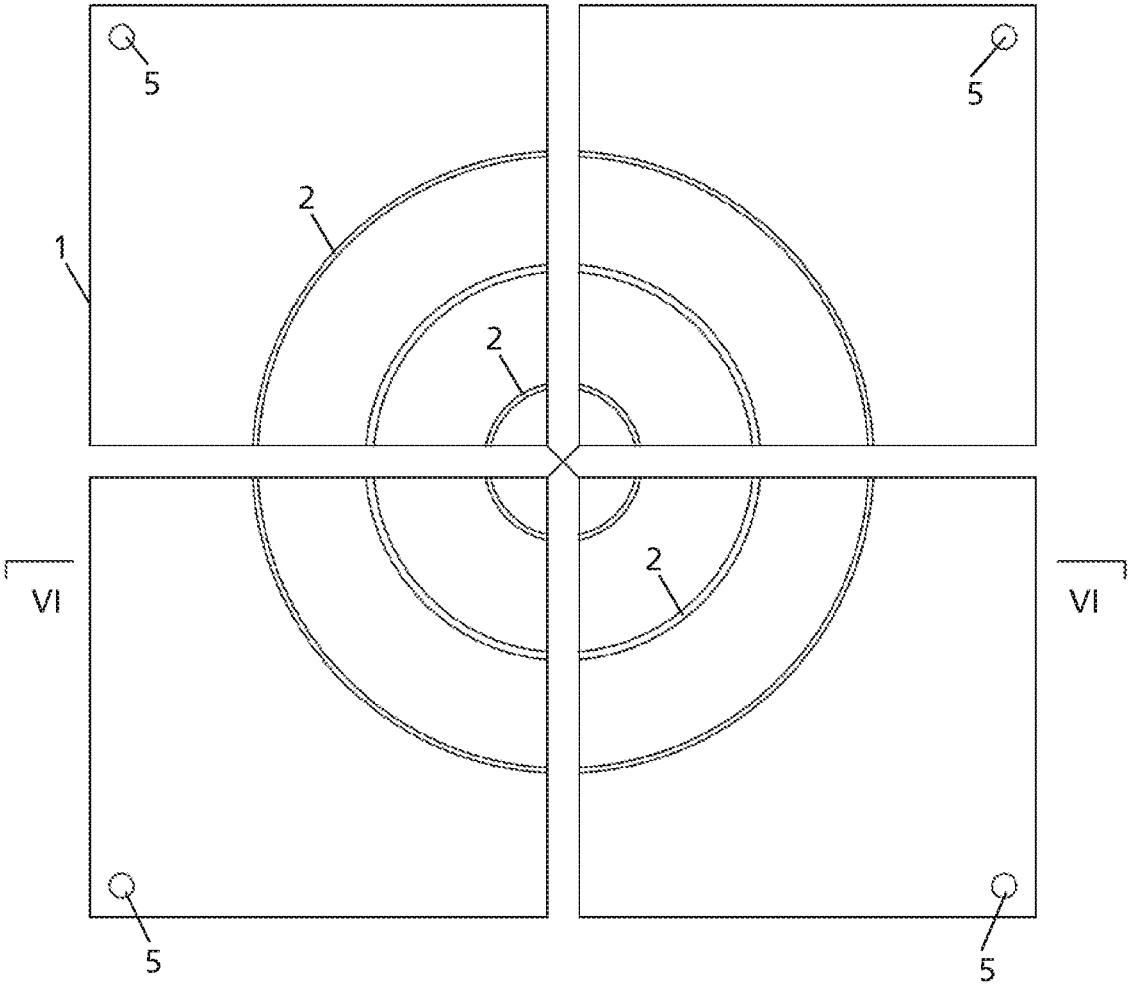
FIG. 5 shows a plan view of an exemplary embodiment of a timber element having round incisions.
Figure 6:
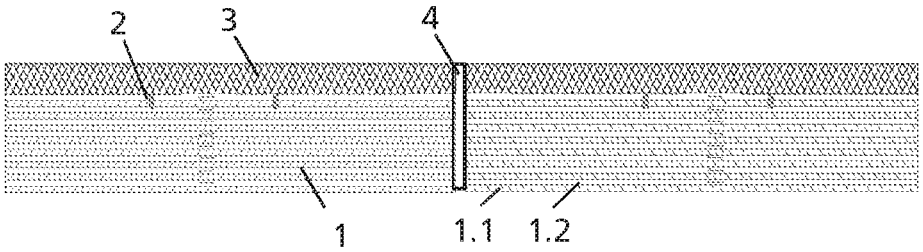
FIG. 6 shows a section through the line VI-VI of the exemplary embodiment of the timber element of FIG. 5 with the applied concrete layer.

FIGS. 5 and 6 shows an exemplary embodiment of timber elements 1 consisting of cross-laminated timber having layers with a first main fiber direction 1.1 and layers 1.2 with a second main fiber direction (preferably at a right angle to the first). In this exemplary embodiment, the timber element 1 is also formed by a plurality of cross-laminated timber elements which are connected at the end sides. The end-side connection 4 can be achieved by an adhesive bond, which is described in detail in WO2014/173633, or other connection techniques. Alternatively, the four panels illustrated here can also be produced from a single panel. The incisions 2 can be formed, for example, by circles (see FIG. 5), rectangles, ellipses, crosses or closed or non-closed curves. However, other forms of the incisions 2 which lead to a cambering of the timber element 1 are also possible. They are preferably oriented coaxially about an apex. These circles or other shapes make it possible to produce two-dimensionally arcuate timber elements 1 (such as a vault).

Figure 7:
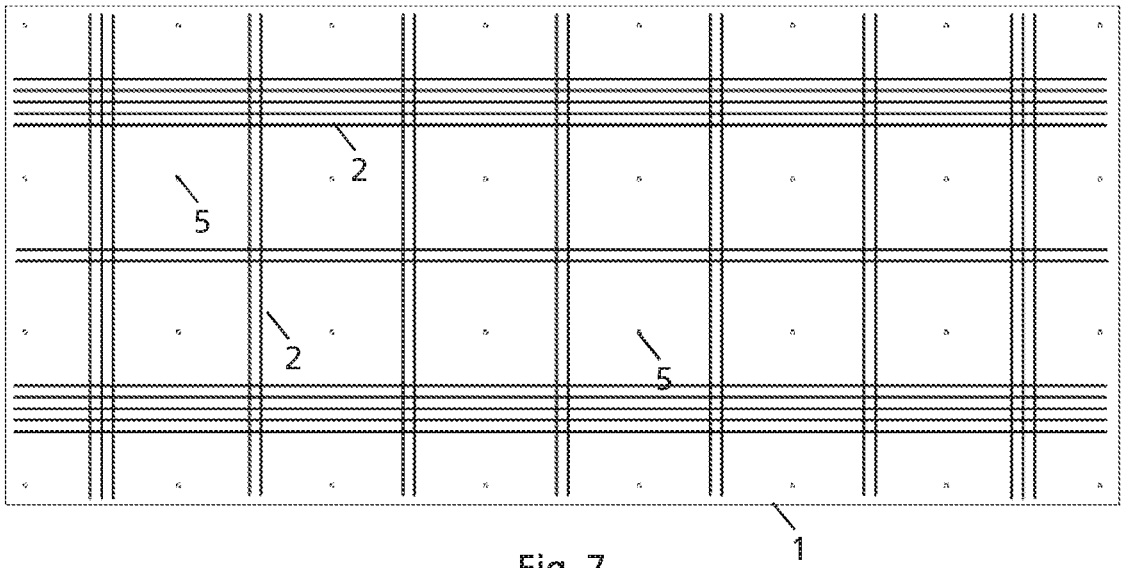
FIG. 7 shows a multifield timber element having incisions arranged in a cross shape.
Figure 8:
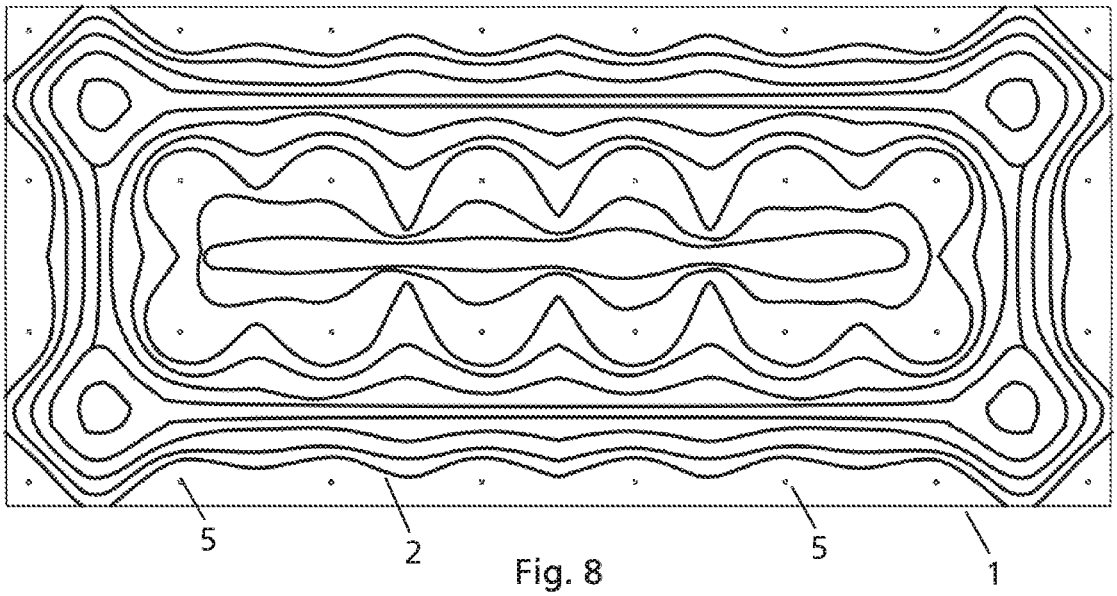
FIG. 8 shows a multifield timber element having freely formed incisions.

FIGS. 7 and 8 show different shapes for the incisions 2 for multifield timber elements 1 or timber panels. What is meant here by multifield is that the timber panel 1 is produced from a plurality of smaller timber panels (fields). This makes it possible to achieve large timber panels which are mounted on holders 5, for example supporting pillars. In FIG. 7, the camber is achieved by incisions 2 arranged in a cross shape (at a right angle to one another). FIG. 8 shows an example of freely extending incisions 2.

Figure 4:
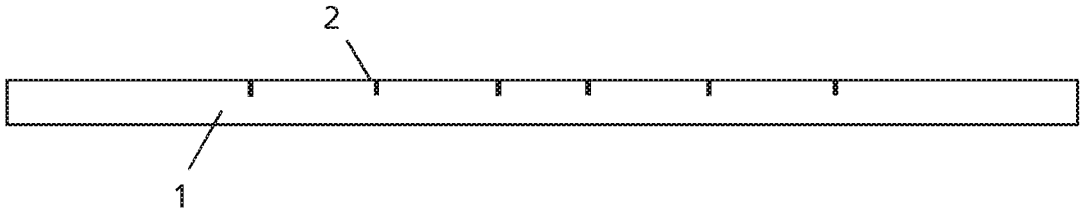
FIG. 4 shows an alternative embodiment of the timber element from FIG. 1.

The arrangement of the incisions 2 is an important parameter for controlling the desired shape of the curvature. In one exemplary embodiment (see FIGS. 1 to 3), the incisions 2 are rectilinear and parallel to one another. This affords a cambering of the timber part in a straight line at a right angle to the incisions. Since the cambering should as a rule follow a main fiber direction, the incisions 2 are preferably formed at a right angle to the main fiber direction of the timber element 1. In another exemplary embodiment, the incisions 2 are arranged coaxially to one another. Two-dimensional cambering (vaults) can thus be formed. The distance between two incisions 2 allows the magnitude of the curvature to be locally varied. In FIG. 4, the cambering at the apex or in the center of the timber element 1 is increased by a narrow distance between the incisions 2 at the apex or in the center of the timber element 1. This means that the central incisions 2 have a smaller distance apart than the outer incisions 2. In the case of circular incisions 2, the distance between two central incisions 2 would indeed be given by the diameter of the incision 2. The shape of the longitudinal axis of the incisions 2 also has an influence on the shape of the cambering. In the case of rectilinear incisions 2, the cambering is achieved in one direction. In the case of coaxial circular incisions 2, a round vault-like cambering is achieved.

Other parameters for the configuration of the cambering are the depth of the incisions 2 and/or the width of the incisions 2 and/or the expansive material.

The described cambered timber elements 1 can also be used for other timber composite ceilings having a different composite material. Other composite materials than concrete are, for example, cement, mortar, plastic or still other conceivable composite materials. Concrete is intended to be used in the description only as an example of a composite material. The described cambered timber elements 1 can also generally be used for ceilings and roofs having load-bearing curved timber elements 1, for example for timber-stack ceilings. The described curved timber elements 1 can also be used for other use purposes than ceilings and roofs, for example for bridges.

Figure 9:
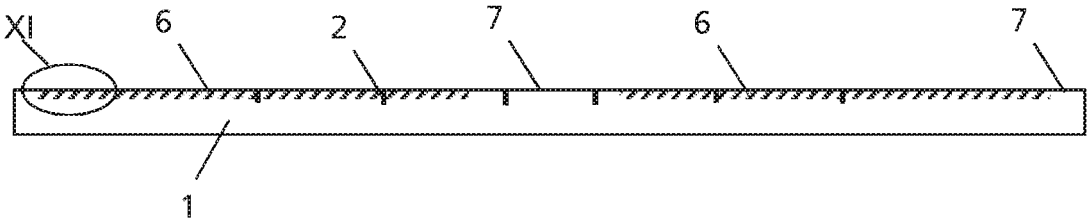
FIG. 9 shows an alternative embodiment of the timber element from FIG. 1 having micro-notches.
Figure 10:
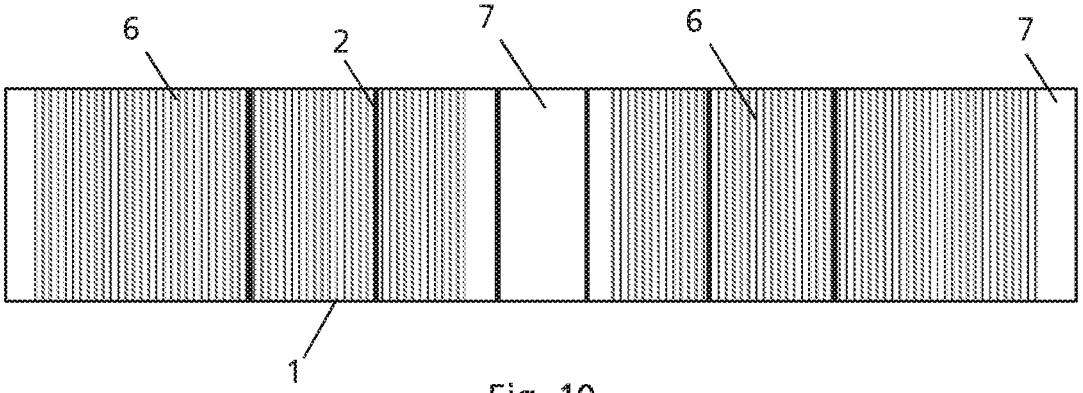
FIG. 10 shows a plan view of the timber element from FIG. 9.

FIGS. 9 and 10 shows a variation of the timber element 1 from FIG. 1. The timber element 1 additionally has, on the surface on which the concrete layer is intended to bear, micro-notches which creates a connection between the timber element 1 and the concrete 3, requiring no screws or other connecting elements. The surface preferably has regions 6 with micro-notches and regions 7 without micro-notches. In the exemplary embodiment shown, the regions 7 without micro-notches are arranged at the extremities at which the timber element 1 is carried by the supports 5 and/or at the apex/in the center of the timber element 1. However, the regions 6 with the micro-notches can also be arranged over the entire surface or in other regions. The longitudinal axes of the micro-notches that are shown in FIG. 10 are arranged at a right angle to the or to one of the main fiber direction(s) of the timber element 1.

Figure 11:
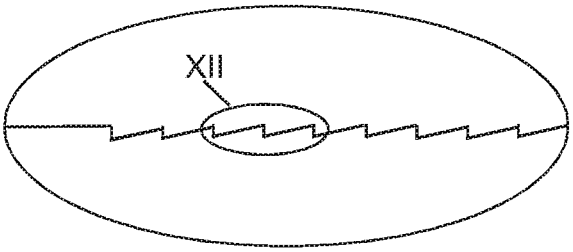
FIG. 11 shows an enlargement of the region XI of the micro-notches of the timber element from FIG. 10.

FIG. 11 shows a first enlargement XI of the micro-notches from FIG. 9 in a cross section oriented at a right angle to the longitudinal axis of the micro-notches. The micro-notches are wedge-shaped with a short cut side and a long cut side. The short cut side of the micro-notches is preferably arranged on the side of the micro-notches which points toward the holder 5, i.e. the normal to the surface of the short cut side of the micro-notches points in the direction of the center of the timber element between the holders 5. There are preferably at least two regions 6 with micro-notches on the surface of the timber element, wherein the micro-notches in the at least two regions 6 are each oriented differently. A different orientation can, for example, the arrangement of the short cut side (in each case on the side of the holder 5) and/or the orientation of the longitudinal axis of the micro-notches in the at least two regions 6. Preferably, the projection of the gradient of the slope of the long cut side is onto the surface parallel to the or one of the main fiber direction(s) of the timber element 1. The surface of the timber element 1 can also be understood to mean here, in regions 6 of the micro-notches, the plane of the unprocessed surface 7.

Figure 12A:
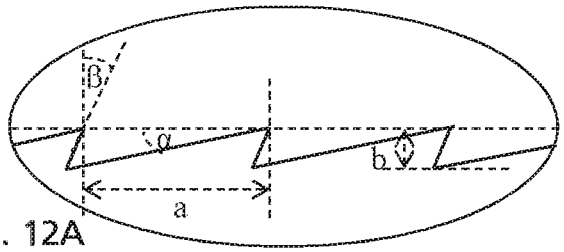
FIG. 12A shows an enlargement of the region XII of the micro-notches of the timber element from FIG. 11.

FIG. 12A shows a further enlargement XII of the micro-notches from FIG. 11. The angle $\alpha$ between the long cut side and the surface of the timber element 1 is preferably less than 30°, preferably less than 20°, preferably less than 15°. The angle $\alpha$ between the long cut side and the surface of the timber element 1 is preferably greater than or equal to 5°. The angle $\beta$ between the orthonormal of the surface of the timber element 1 and the short cut side of the micro-notches can be 0°, i.e. the micro-notches have a short cut side which is arranged at a right angle to the surface of the timber element 1. Preferably, however, the short cut side is undercut, with the result that the concrete layer wedges in the short cut sides. By contrast with the separately formed undercuts in the prior art, this has the advantage that the undercut is jointly realized directly with the micro-notches and thus produces to a more uniform wedging of the timber element with the concrete layer over the surface of the timber element 1. The angle $\beta$ is preferably less than 30°, preferably less than 20°, preferably less than 15°.

Here, the micro-notches are preferably dimensioned to be so small that a surprisingly good connection between concrete and timber element 1 can be achieved, and at the same time the timber wear can be minimized and the load-bearing capacity of the timber element 1 can be maximized. For this purpose, the micro-notch has a depth (b) of less than 10 mm, preferably less than 6 mm, and a width (a) of less than 100 mm, preferably less than 60 mm. The depth is preferably greater than 2 mm and a width is greater than 7 mm, preferably greater than 20 mm. A particularly good result has been obtained with a 4 mm depth and a 45 mm width.

Figure 12B:
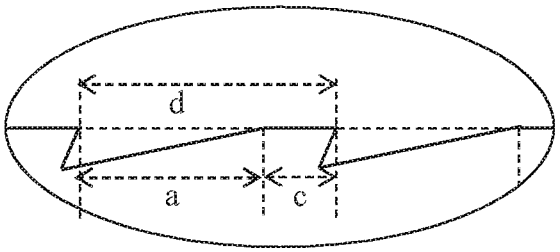
FIG. 12B shows an alternative embodiment of the enlargement of the region X of the micro-notches of the timber element from FIG. 11.

Whereas in the exemplary embodiment of the micro-notches that is shown in FIG. 12A the width a of the micro-notches corresponds to the distance d between two micro-notches, the micro-notches can also have a distance d which is greater than the width a. Such an exemplary embodiment is shown in FIG. 12B. In that figure, a further distance c is formed between that end of the long cut side which leads back onto the surface and that end of the short cut side which leads onto the surface, where a+c=d. In one exemplary embodiment, the distance d between two adjacent micro-notches is less than twice the width a. In one exemplary embodiment, the distance d between two adjacent micro-notches is less than 500 mm, preferably less than 300 mm, preferably less than 200 mm.

Figure 13:
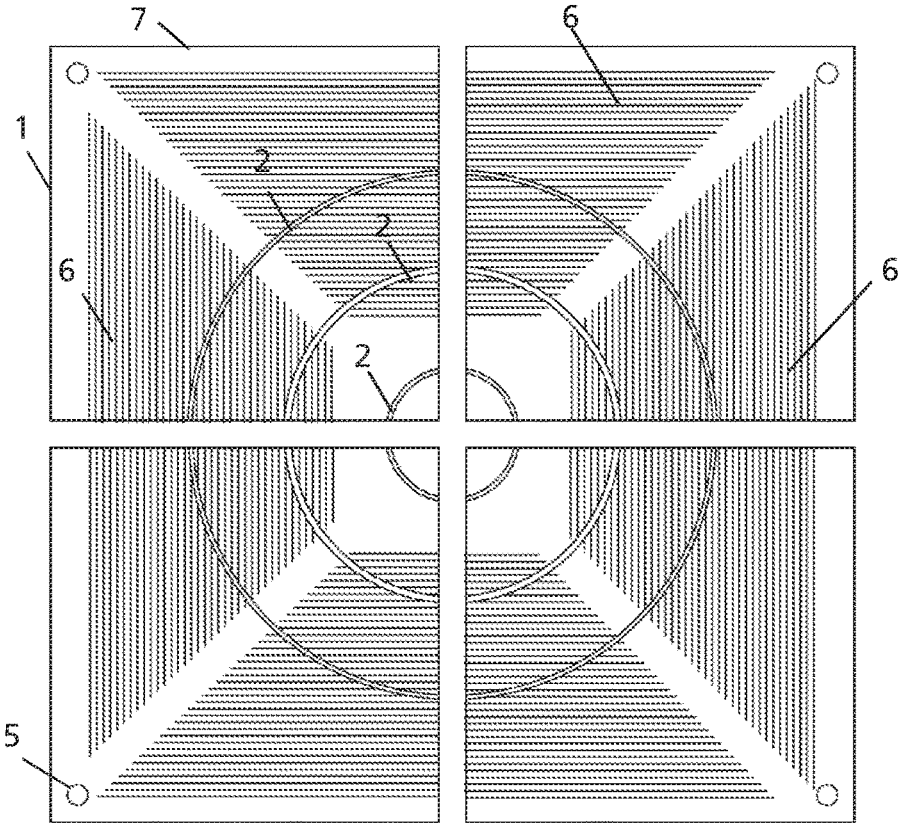
FIG. 13 shows an alternative embodiment of the timber element from FIG. 5 having micro-notches parallel to the sides.
Figure 14:
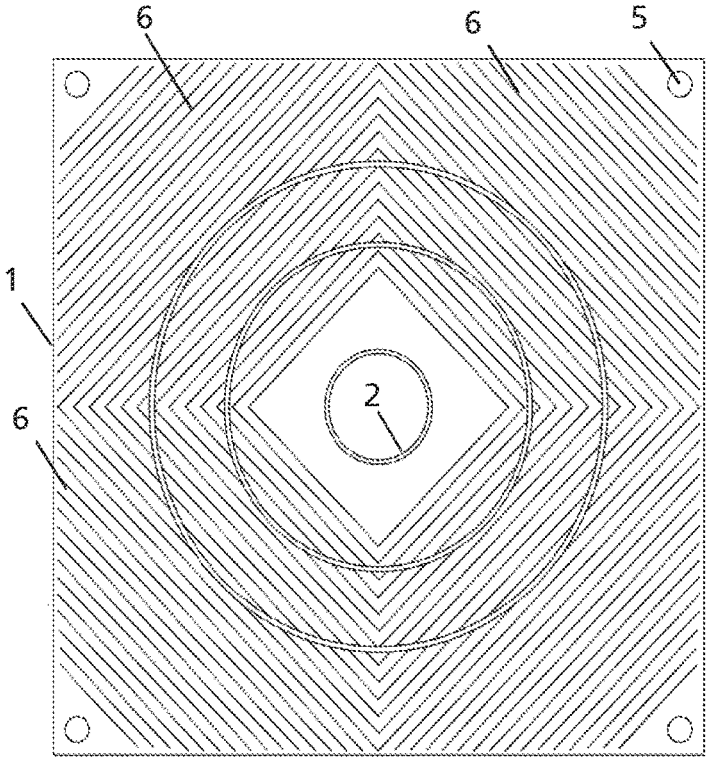
FIG. 14 shows an alternative embodiment of the timber element from FIG. 5 having micro-notches diagonal to the sides.

FIG. 13 now shows the exemplary embodiment from FIG. 5 with the micro-notches described. The micro-notches are here formed parallel to the four sides of the timber element 1, with the result that the longitudinal axes of the micro-notches form a rectangle about the center point or the apex of the timber element 1. FIG. 14 shows an alternative exemplary embodiment of FIG. 13 with micro-notches which extend diagonally to the sides of the timber panel 1. Alternatively, the longitudinal axes (which would here rather be tangents) of the micro-notches form a circle line. The shape of the micro-notches in the longitudinal direction (at a right angle to the cross section shown in FIGS. 9 and 10) can be chosen as desired.

The described exemplary embodiments of FIGS. 9 to 14 show a very advantageous combination of micro-notches and incisions 2. However, the micro-notches can also be used for TCC ceilings without incisions 2 and curvature.

Figure 15:
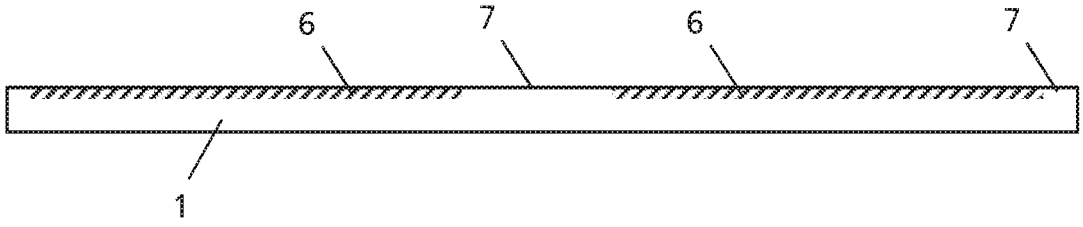
FIG. 15 shows an alternative embodiment of the timber element from FIG. 9 without incisions.
Figure 16:
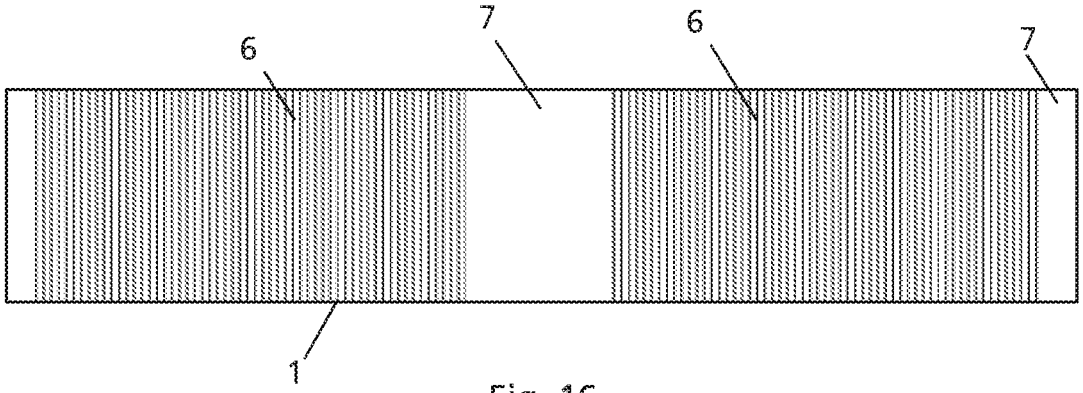
FIG. 16 shows a plan view of the timber element from FIG. 15.

Thus, for example, FIGS. 15 and 16 shows a timber element 1 for a TCC ceiling with micro-notches which must not necessarily have incisions 2. The micro-notches preferably have a wedge-shaped form in a cross section at a right angle to the longitudinal axis. The short cut side preferably has an undercut. The micro-notches preferably have a depth (b) of less than 10 mm, preferably less than 6 mm, and a width (a) of less than 100 mm, preferably less than 60 mm. The depth is preferably greater than 2 mm and the width greater than 7 mm, preferably greater than 20 mm. The micro-notches are preferably configured as described above.

Figure 17:
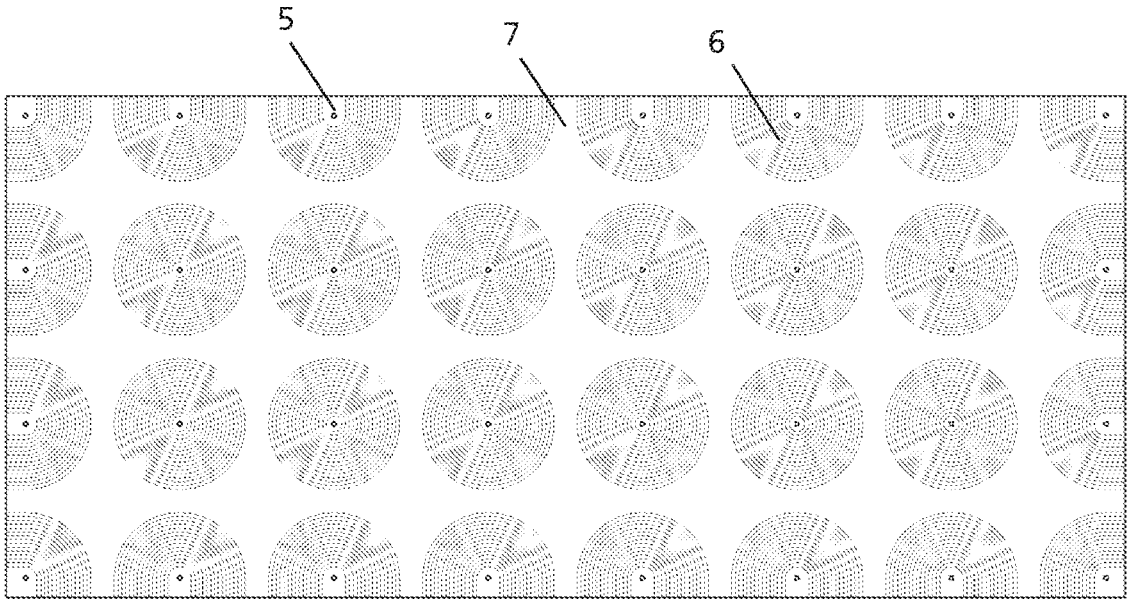
FIG. 17 shows a multifield timber element having circular micro-notches without incisions.
Figure 18:
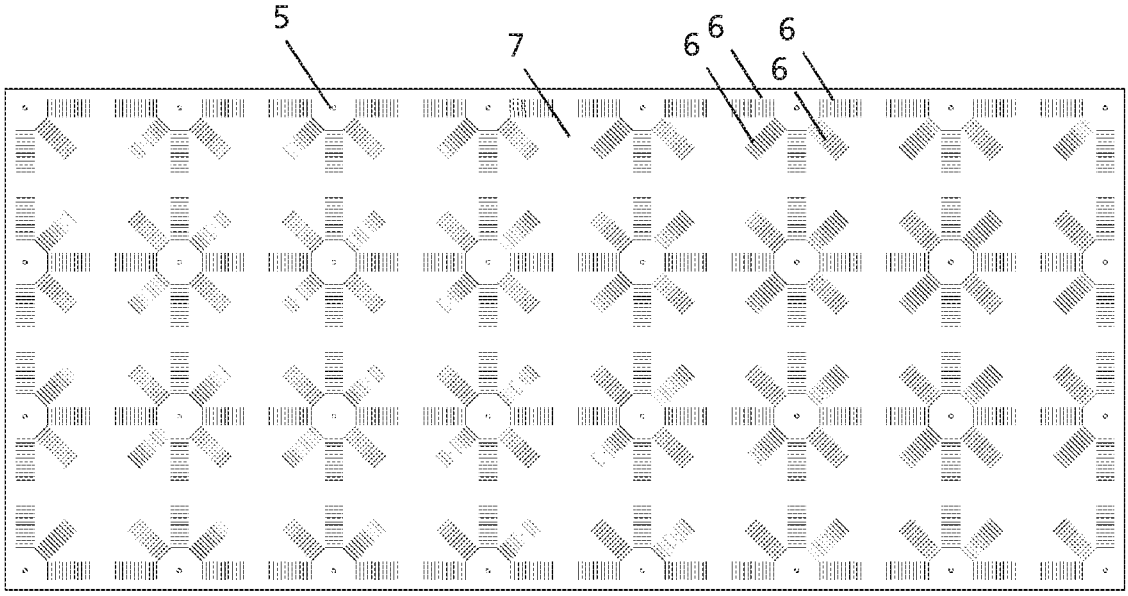
FIG. 18 shows a multifield timber element having star-shaped micro-notches without incisions.
Figure 19:
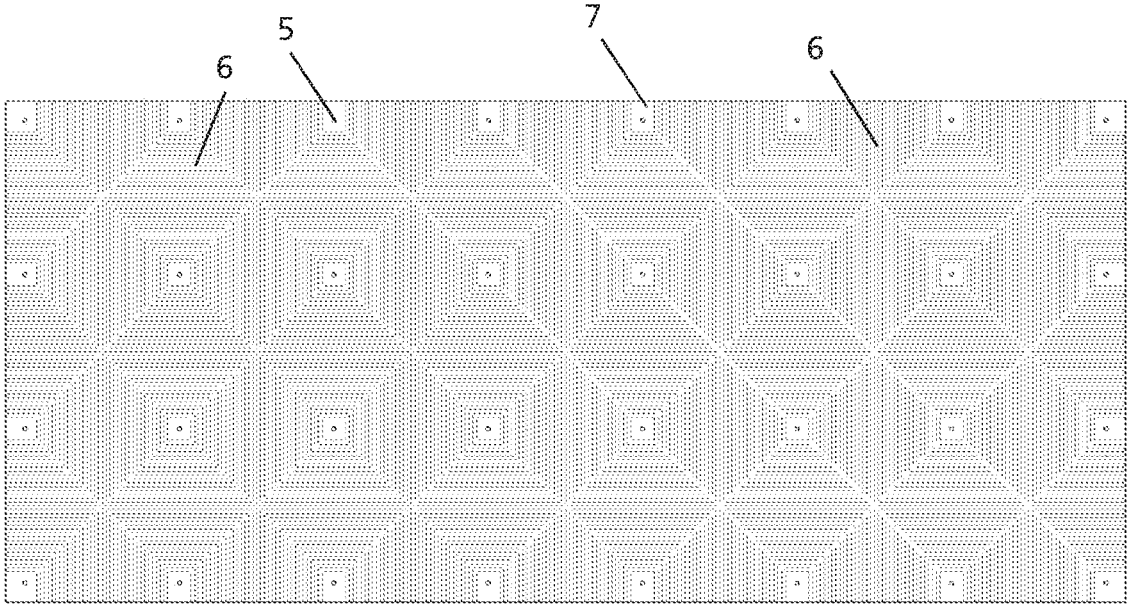
FIG. 19 shows a multifield timber element having fields with different micro-notch orientations without incisions.

FIGS. 17 to 19 show various examples of multifield timber panels 1 for TCC ceilings with micro-notches 6. In FIG. 17, the micro-notches are circular. The circles of the micro-notches preferably extend around corresponding holders 5 (preferably supporting pillars). In FIG. 18, the micro-notches are cross-shaped, star-shaped or sun-shaped, that is to say with radially extending micronotch regions. The micronotch regions have micro-notches with longitudinal axes which extend at a right angle to the corresponding radial direction. The radial regions of the micro-notches preferably extend from corresponding holders 5 (preferably supporting pillars). The micro-notches in FIGS. 17 and 18 are preferably arranged in such a way that the short cut sides are formed on the side of the holder 5. In FIG. 19, individual fields are formed with uniform micro-notches. However, the fields are assembled to form the timber panel 1 in such a way that adjacent fields have different longitudinal directions of the micro-notches.

The invention claimed is:

1. A method for cambering a timber element, comprising the following steps:

cutting at least one incision into a surface of the timber element;

inserting an expansive material into the at least one incision of the timber element;

allowing the expansive material to expand in the at least one incision, with the result that a cambering of the timber element is achieved.

2. The method as claimed in claim 1, wherein the expansive material is an expanding mortar.

3. The method as claimed in claim 1, wherein the incisions have a width of 1 mm to 100 mm.

4. The method as claimed in claim 1, wherein the incisions have a depth of 5 mm to 150 mm.

5. The method as claimed claim 1, wherein the timber element has a main fiber direction parallel to the surface of the timber element.

6. The method as claimed in claim 5, wherein the timber element is a solid timber or a dowel laminated timber support whose longitudinal axis is parallel to the main fiber direction, wherein the longitudinal axis of the at least one incision is arranged at a right angle to the main fiber direction.

7. The method as claimed in claim 1, wherein the timber element has, parallel to the surface of the timber element, a plurality of timber layers which have, in alternation, a first main fiber direction which is parallel to the surface of the timber element, and a second main fiber direction which is parallel to the surface of the timber element and at a right angle to the first main fiber direction.

8. The method as claimed in claim 1, wherein the cambered timber element is a part of a ceiling or of a roof.

9. A method for producing a ceiling or a roof, comprising the following steps:

cutting at least one incision into a surface of at least one timber element;

inserting an expansive material into the at least one incision of the at least one timber element;

allowing the expansive material to expand in the at least one incision, with the result that a cambering of the timber element is achieved, producing the ceiling or the roof with the at least one cambered timber element.

10. The method as claimed in claim 9, wherein the at least one cambered timber element is held by holders, and the curvature is formed in such a way that the at least one cambered timber element forms a curvature between the holders, or that the curvature of the at least one timber element counteracts the weight and/or the load of the ceiling.

11. The method as claimed in claim 9, wherein the ceiling is a timber composite ceiling, wherein the method comprises the step of applying a composite material layer to the surface of the at least one cambered timber element.

12. The method as claimed in claim 11, wherein the composite material is concrete.

13. The method as claimed in claim 11, wherein the composite material is applied to the side of the cambered timber elements which is situated opposite the at least one surface of the at least one cambered timber element having the at least one incision.

14. The method as claimed in claim 11, wherein the surface of the timber element has a plurality of micro-notches which, in a cross section which extends at a right angle to the longitudinal axis of the micro-notches, are formed in a wedge-shaped manner with a short cut side and a long cut side.

15. The method as claimed in claim 14, wherein the micro-notches have a depth which is less than 10 mm and a width which is less than 100 mm.

16. The method as claimed in claim 14, wherein the long cut side and the surface of the timber element enclose an angle of less than 30°.

17. The method as claimed in claim 14, wherein the short cut side is undercut.

18. The method as claimed in claim 14, wherein the surface of the timber element has a first micro-notch region and a second micro-notch region, wherein, in the first micro-notch region, the short cut side is formed on a side of the micro-notches which points toward a first holder, and, in the second micro-notch region, the short cut side is formed on a side of the micro-notches which points toward a second holder.

19. The method as claimed in claim 18, wherein the short cut side in the first and second micro-notch region is in each case formed on the side of the micro-notches which points away from the respective other micro-notch region.

20. A cambered timber element comprising: at least one incision in a surface of the timber element, wherein the at least one incision is filled with an expanded expansive material; wherein the surface of the cambered timber element has a plurality of micro-notches, which, in a cross section which extends at a right angle to the longitudinal axis of the micro-notches, are formed in a wedge-shaped manner with a short cut side and a lone cut side, wherein the micro-notches have a depth which is less than 10 mm and a width which is less than 100 mm.

21. A timber composite ceiling comprising:

a cambered timber element; and a layer of a composite material on the surface of the cambered timber element, wherein the cambered timber element has at least one incision in a surface of the timber element, wherein the at least one incision is filled with an expanded expansive material, wherein the surface of the cambered timber element has a plurality of micro-notches, which, in a cross section which extends at a right angle to the longitudinal axis of the micro-notches, are formed in a wed e-shaped manner with a short cut side and a long cut side, wherein the micro-notches have a depth which is less than 10 mm and a width which is less than 100 mm.

22. The timber-concrete composite ceiling as claimed in claim 21, having holders for holding the timber element, wherein the at least one incision is arranged between the holders.

23. The timber-concrete composite ceiling as claimed in claim 21, wherein the expansive material is an expanding mortar in an expanded state.

24. The timber-concrete composite ceiling as claimed in claim 21, wherein the composite material is concrete.

* * * * *